US011643839B2

(12) United States Patent
Jackson et al.

(10) Patent No.: US 11,643,839 B2
(45) Date of Patent: May 9, 2023

(54) SYSTEMS AND METHODS FOR PULLING AND INSTALLING POSTS

(71) Applicant: Cives Corporation, Alpharetta, GA (US)

(72) Inventors: Michael P. Jackson, Harrisville, NY (US); Ryan E. Tuttle, Gouverneur, NY (US); Travis R. Moser, Croghan, NY (US); Jacob D. Erdman, Gouverneur, NY (US)

(73) Assignee: CIVES CORPORATION, Alpharetta, GA (US)

( * ) Notice: Subject to any disclaimer, the term of this patent is extended or adjusted under 35 U.S.C. 154(b) by 337 days.

(21) Appl. No.: 16/596,882

(22) Filed: Oct. 9, 2019

(65) Prior Publication Data

US 2021/0108441 A1 Apr. 15, 2021

Related U.S. Application Data

(60) Provisional application No. 62/827,424, filed on Apr. 1, 2019.

(51) Int. Cl.
*E04H 17/26* (2006.01)
*B66C 1/42* (2006.01)

(52) U.S. Cl.
CPC ..... *E04H 17/263* (2013.01); *B66C 1/427* (2013.01); *E04H 17/265* (2013.01)

(58) Field of Classification Search
CPC ..... E04H 17/263; E04H 17/265; B66C 1/427
USPC ..... 414/10–12; 254/30
See application file for complete search history.

(56) References Cited

U.S. PATENT DOCUMENTS 2,787,383 A * 4/1957 Antos ..... B66C 23/36 212/264
2,950,603 A 8/1960 Matthew et al.
3,026,949 A 3/1962 Eldridge et al.
3,117,635 A 1/1964 John
3,301,416 A * 1/1967 Bopp ..... B60P 1/5466 212/199
3,396,852 A * 8/1968 Bakula ..... B66C 13/18 212/304
3,576,218 A 4/1971 Lisenby
(Continued)

OTHER PUBLICATIONS

Office Action dated Jul. 8, 2021, by the Canadian Intellectual Property Office in corresponding Canadian Patent Application No. 3,077,473. (3 pages).

*Primary Examiner* — Lynn E Schwenning
(74) *Attorney, Agent, or Firm* — Panitch Schwarze Belisario & Nadel LLP

(57) ABSTRACT

A system for pulling posts is disclosed. The system for pulling posts comprises a mast extending along a direction having a vertical component, an elongated arm rotatably and pivotably supported by the mast and extending at an angle relative to the mast, a pusher with first and second opposite ends, the first end of the pusher being configured to support the elongated arm at a first location of the elongated arm, and the second end of the pusher being configured to contact a ground surface, the pusher being configured to increase in length to drive the first location of the elongated arm away from a ground surface and thereby change the angle relative to the mast, and a pole attachment site at a second location of the elongated arm.

18 Claims, 5 Drawing Sheets

(56) References Cited

U.S. PATENT DOCUMENTS

| | | | | | |
|---|---|---|---|---|---|
| 3,576,311 | A * | 4/1971 | Cartner | E02D 9/02 | 254/30 |
| 3,848,850 | A * | 11/1974 | Bemis | E01F 9/60 | 414/23 |
| 4,738,433 | A * | 4/1988 | Hoff | E04H 17/265 | 254/30 |
| 5,494,117 | A | 2/1996 | Aldridge | | |
| 6,398,188 | B1 | 6/2002 | Salman | | |
| 6,976,670 | B1 * | 12/2005 | Woolley | E04H 17/265 | 254/133 R |
| 7,204,535 | B2 | 4/2007 | Hansen | | |
| 7,926,786 | B2 | 4/2011 | Slagle | | |
| 7,950,470 | B2 | 5/2011 | Reid | | |
| 8,608,132 | B1 | 12/2013 | Allen | | |
| 9,074,334 | B2 | 7/2015 | Palmlund et al. | | |
| 9,446,932 | B2 | 9/2016 | Nobles | | |
| 10,015,937 | B2 | 7/2018 | Maxwell | | |
| 10,450,771 | B2 * | 10/2019 | Buckner | B60P 3/40 | |
| 2015/0093217 | A1 * | 4/2015 | St-Yves | B25J 15/024 | 414/23 |

* cited by examiner

SYSTEMS AND METHODS FOR PULLING AND INSTALLING POSTS

TECHNICAL FIELD

The present disclosure relates to systems and methods for pulling and installing posts, and more specifically to highway guardrail posts.

BACKGROUND INFORMATION

Various problems are associated with known post pullers. For example, the post puller described in U.S. Pat. No. 6,398,188 requires a large operating space around the post to accommodate a base and two lateral hydraulic cylinders. This post puller also involves a large number of components, thus increasing complexity, risk of failure, and cost.

SUMMARY

A system for pulling posts comprises a mast extending along a direction having a vertical component, an elongated arm rotatably and pivotably supported by the mast and extending at an angle relative to the mast, a pusher with first and second opposite ends, the first end of the pusher being configured to support the elongated arm at a first location of the elongated arm, and the second end of the pusher being configured to contact a ground surface, the pusher being configured to increase in length to drive the first location of the elongated arm away from a ground surface and thereby change the angle relative to the mast, and a pole attachment site at a second location of the elongated arm.

BRIEF DESCRIPTION OF THE DRAWINGS

Other features and advantages disclosed herein will become more apparent from the following detailed description of exemplary embodiments when read in conjunction with the attached drawings.

DETAILED DESCRIPTION

Figure 1:
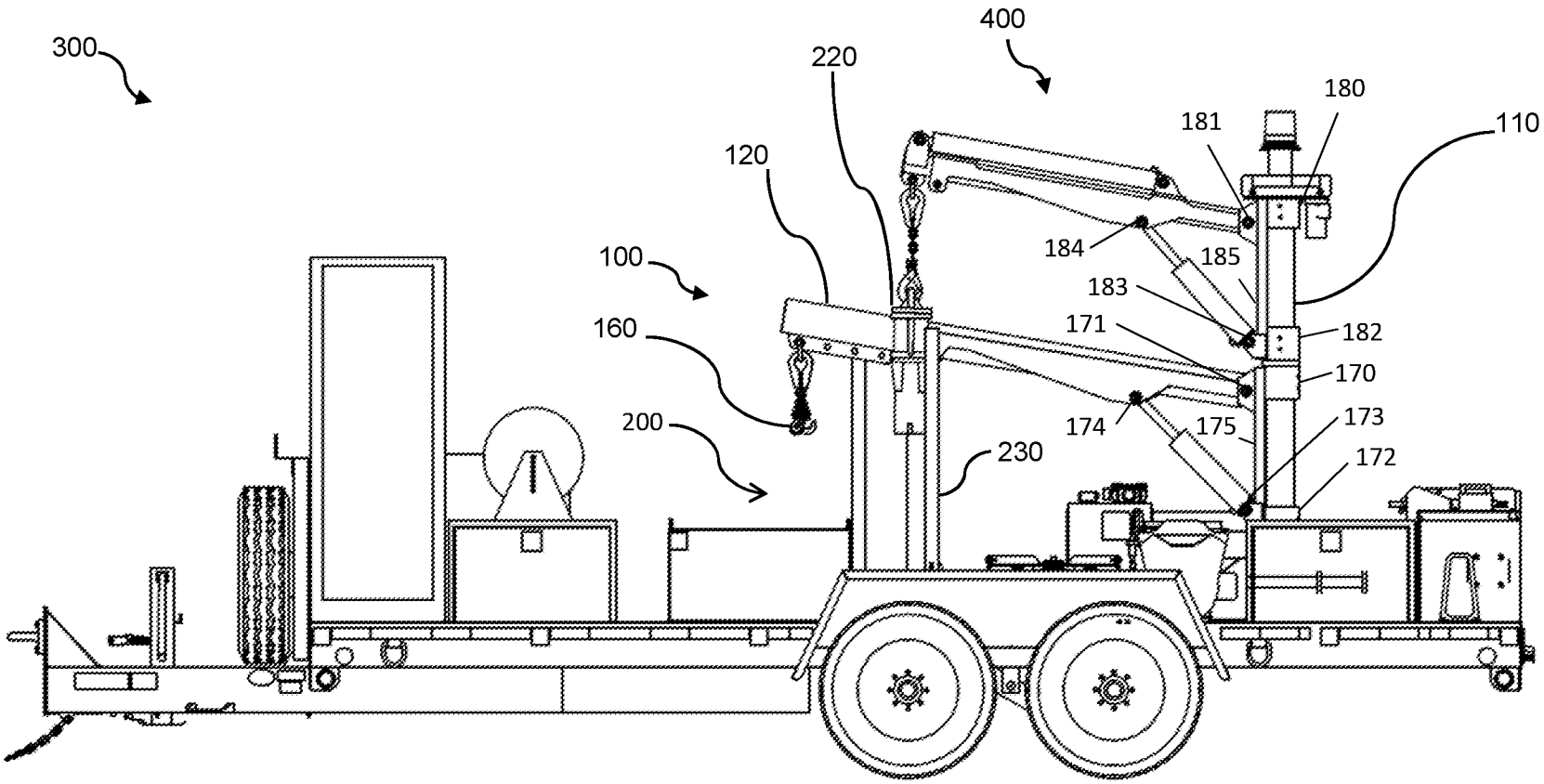
FIG. 1 shows a side view of an exemplary embodiment of a system for pulling and installing posts.
Figure 2:
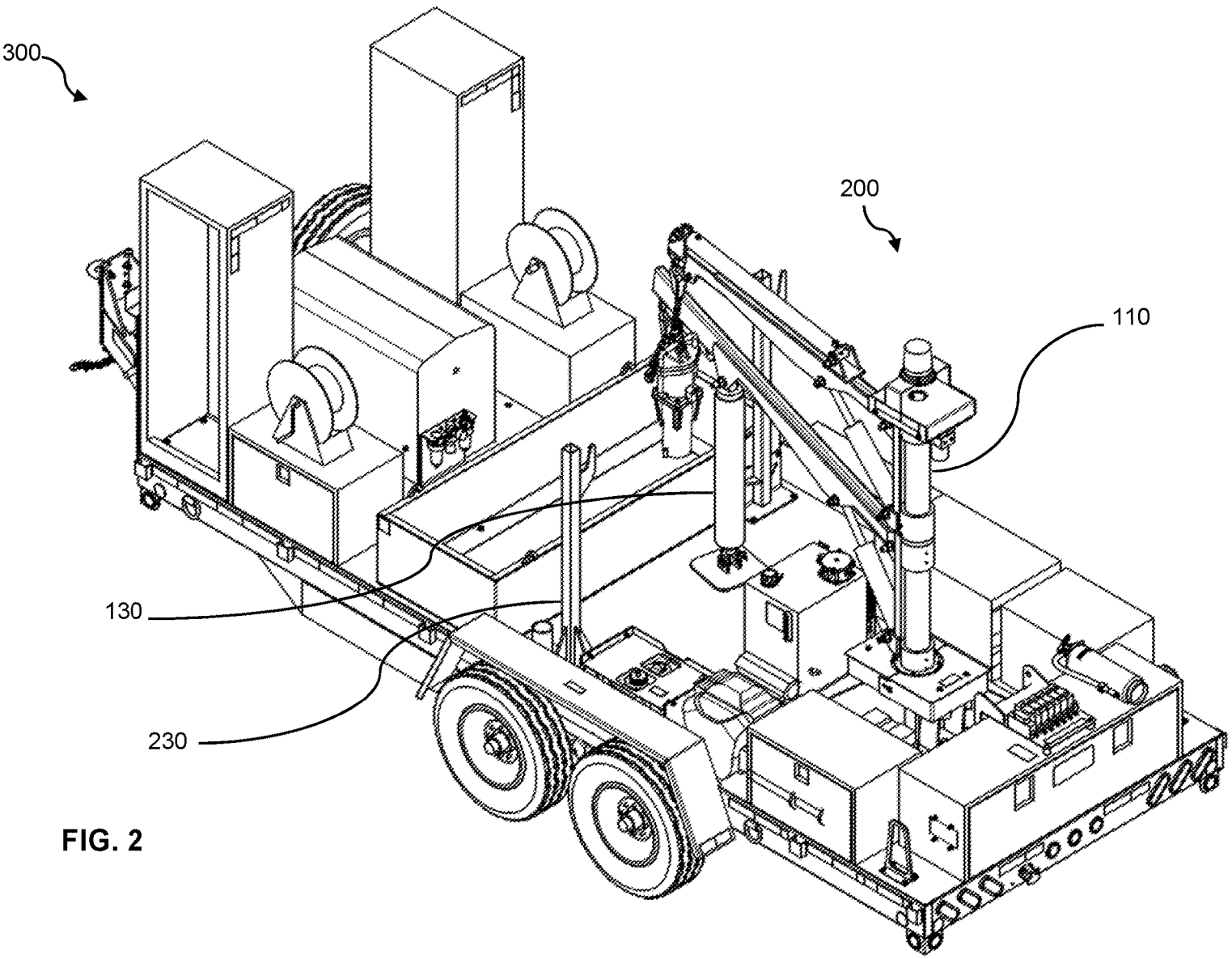
FIG. 2 shows a perspective view of the exemplary embodiment of a system for pulling and installing posts.
Figure 3:
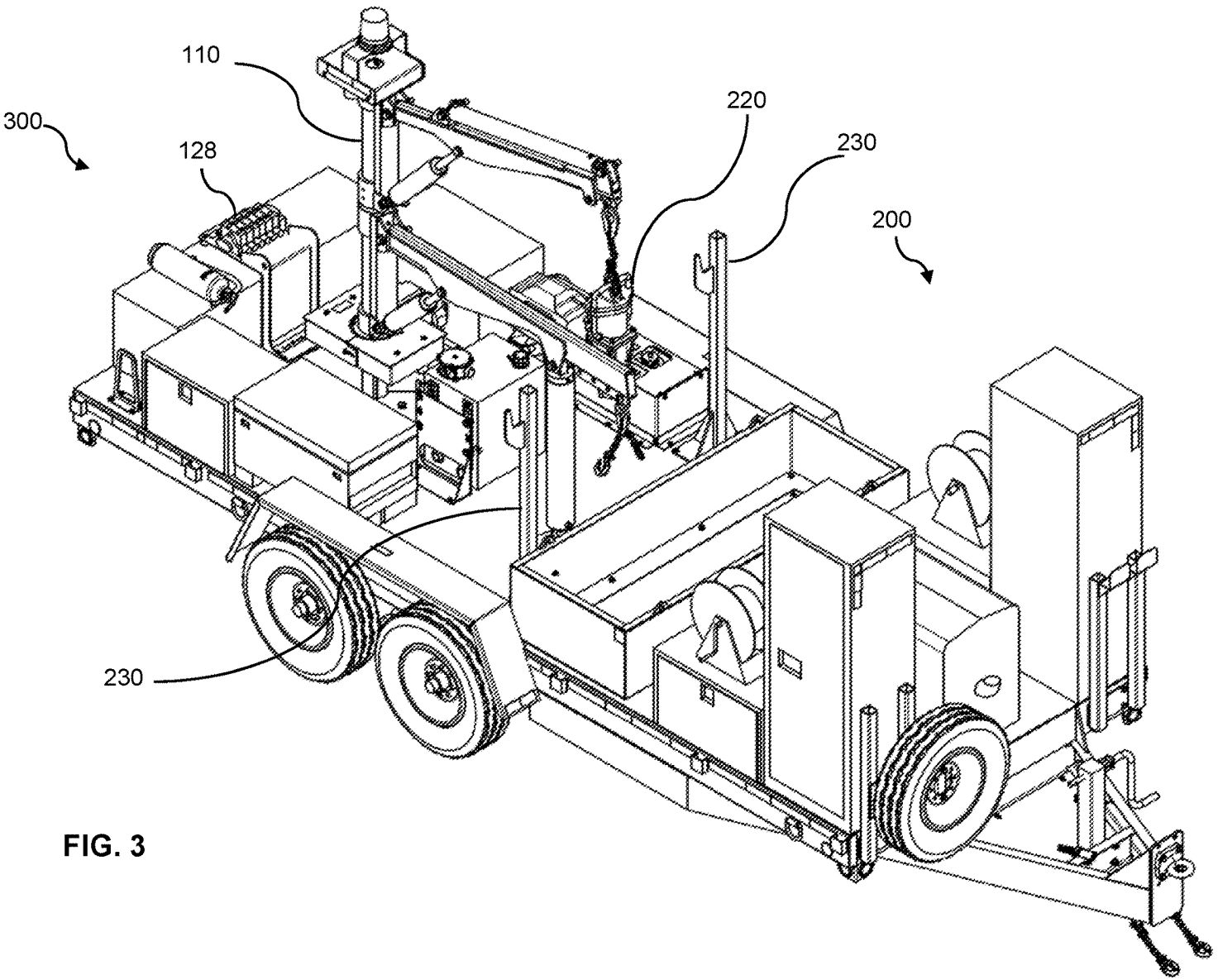
FIG. 3 shows a perspective view of the exemplary embodiment of a system for pulling and installing posts.

FIGS. 1-5 show an exemplary embodiment of a post pulling and installing system 300. However, the present invention is not limited to the details of the exemplary embodiment.

The system 300 includes, in the embodiment, a pulling mechanism 100 for pulling posts, mounted to a trailer 200. The pulling mechanism 100 comprises a mast 110, an elongated arm 120, and a pusher 130 (in the embodiment, a hydraulic cylinder). The mast 110 is fixed to the trailer 200, for example, by bolting or other suitable means for handling mechanical stresses associated with pulling and/or installing posts. The mast 110 extends in the vertical direction in the embodiment, but can extend in a direction having a horizontal component and a vertical component in alternative embodiments. The elongated arm 120 is rotatably and pivotably supported by the mast 110 and extending at an angle relative to the mast 110.

Figure 4:
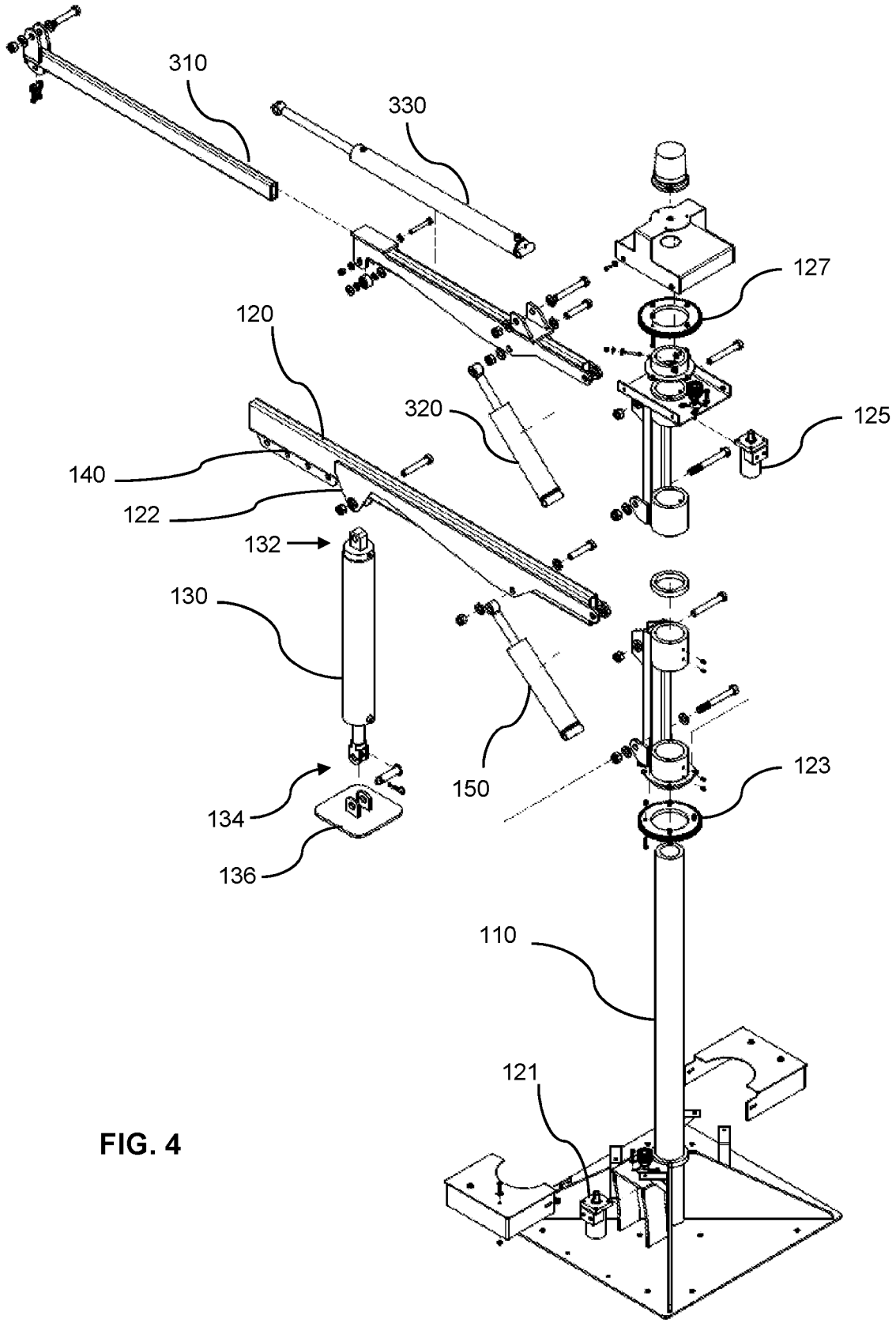
FIG. 4 shows an exploded view of a portion of the exemplary embodiment of a system for pulling and installing posts.
Figure 5:
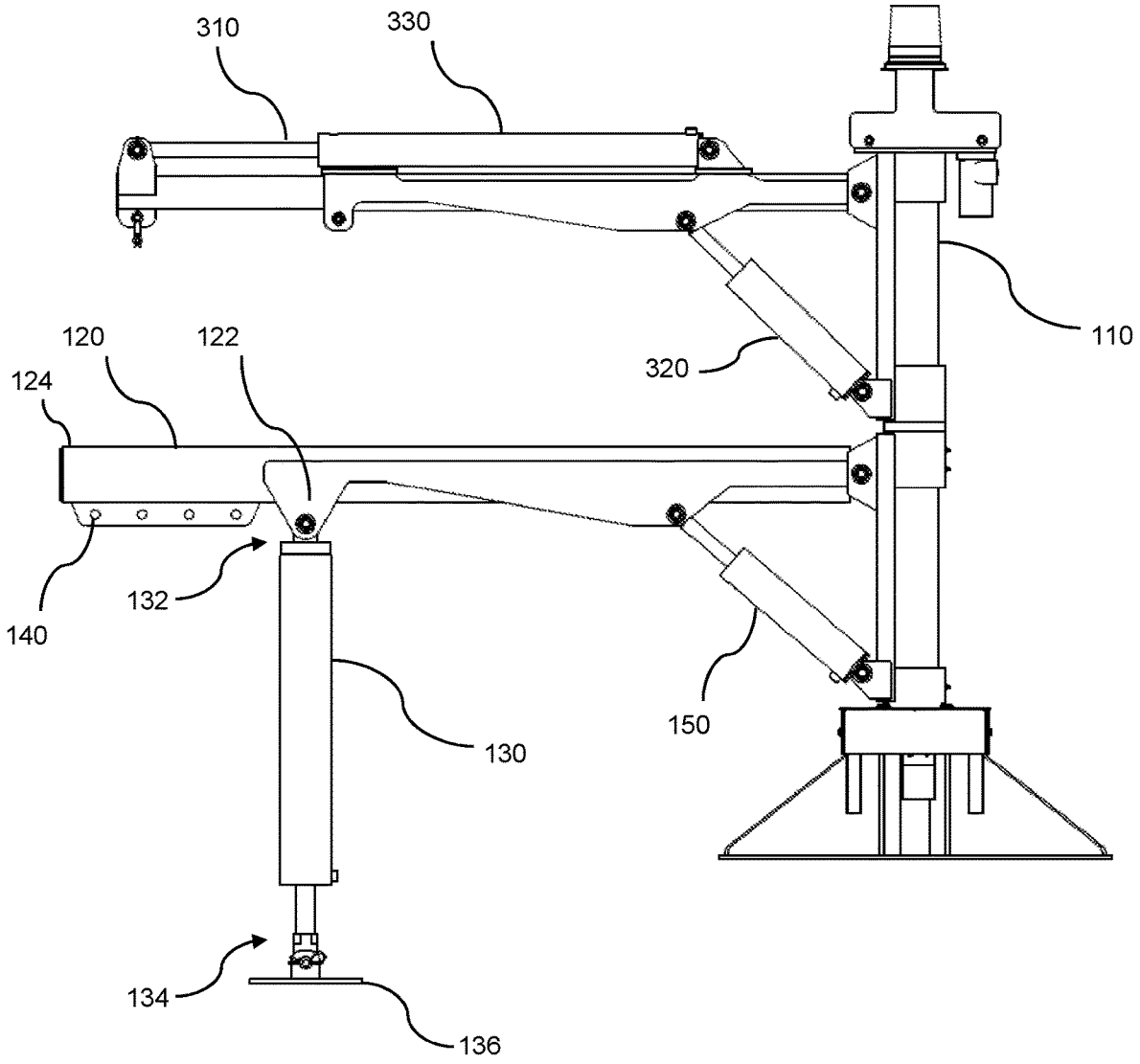
FIG. 5 shows a side view of a portion of the exemplary embodiment of a system for pulling and installing posts.

As shown in more detail in FIGS. 4 and 5, the pusher 130 of the pulling mechanism 100 includes first and second opposite ends 132, 134. The first end 132 of the pusher 130 is configured to support the elongated arm 120 at a first location 122 of the elongated arm 120, and the second end 134 of the pusher 130 is configured to contact a ground surface (e.g., the ground close the location of the post to be pulled and/or installed). The pusher 130 is configured to increase in length to drive the first location 122 of the elongated arm 120 away from a ground surface and thereby change the angle relative to the mast.

In the exemplary embodiment, the rotational support of the elongated arm 120 by the mast 110 is provided by being mounted to a beam 175 which is configured to rotate around the mast 110 without moving axially relative to the mast 110. In particular, in the exemplary embodiment, the beam 175 is fixed, such as by welding, between bushings 170 and 172 that extend at least partially around the mast 110 and are configured to rotate around the mast 110 without moving axially relative to the mast 110.

The elongated arm 120 can be configured to be hand-powered to rotate around the mast 110, or to be driven by a motor to rotate around the mast 110. Such a motor can be electrically powered, hydraulically powered, pneumatically powered, gas powered, or powered in any other suitable manner known in the art. In the exemplary embodiment, a hydraulic motor 121 is configured to rotate the elongated arm 120. In particular, a gear fixed to the output shaft of the hydraulic motor 121 meshes with a gear 123 fixed to the bushing 170/bushing 172/beam 175 assembly, so that actuation of the hydraulic motor 121 in a forward or reverse direction will cause the gear 123, along with the bushing 170/bushing 172/beam 175 assembly and the elongated arm 120, to rotate in a clockwise or counterclockwise direction. Alternatively, the gear 123 can be fixed to the mast 110 and the hydraulic motor 121 configured to rotate with the bushing 170/bushing 172/beam 175 assembly, so that actuation of the hydraulic motor 121 in a forward or reverse direction will cause the hydraulic motor 121, along with the bushing 170/bushing 172/beam 175 assembly and the elongated arm 120, to rotate in a clockwise or counterclockwise direction.

In the exemplary embodiment, the pivotable support of the elongated arm 120 is provided by a hinge mechanism 171, by which the elongated arm 120 is mounted to the beam 175, and which is configured to allow the angle of the elongated arm 120 relative to the mast 110 to vary. In the exemplary embodiment, a hydraulic cylinder 150 is configured to pivot the elongated arm 120 relative to the mast 110. The hydraulic cylinder 150 in the embodiment is mounted at one end, by a hinge mechanism 173, to the beam 175, and at the other end to the elongated arm 120 by a hinge mechanism 174. The hydraulic cylinder 150 therefore rotates with the elongated arm 120 about the mast 110 as the structure including the beam 175 and bushings 170 and 172 is rotated about the mast 110. The elongated arm 120 and hydraulic cylinder 150 can alternatively be rotatably supported about the mast by roller bearings or other types of bearings. Furthermore, instead of the hydraulic cylinder 150, the elongated arm 120 can be configured to be hand-powered to pivot relative to the mast 110, or to be driven by a motor to pivot relative to the mast 110. Such a motor can be electrically powered, hydraulically powered, pneumatically powered, gas powered, or powered in any other suitable manner known in the art.

Furthermore, a pole attachment site 140 is provided at a second location 124 of the elongated arm 120. In the exemplary embodiment, the pusher 130 is a hydraulic cylinder. The pusher 130 can be hinged to the elongated arm 120 at the first location 122. The second end 134 of the pusher 130 can include a plate 136 configured to contact a ground surface or any other surface against which the pusher 130 is arranged to push. The plate 136 can be pivotably fixed to other portions of the pusher 130, for example by a hinge as shown in the exemplary embodiment, or by a universal joint or a ball joint.

In the exemplary embodiment, the pole attachment site 140 includes one or more openings, and a chain 160 is coupled to the pole attachment site 140. In the exemplary embodiment, the chain 160 is a grade 100 chain, which may be more suitable for pulling highway guardrail posts. Alternatively, the chain 160 can be a grade 70 chain, or other grades of chains, depending on the application. The chain 160 is configured to be wrapped around a post. During operation of the pulling mechanism 100, as the pusher 130 increases the distance between the first and second ends 132, 134 of the pusher 130 and the elongated arm 120 is thereby pivotably raised, friction between the chain 160 and the post causes pulling of the post relative to a ground surface or other pushing surface. The pole attachment site 140 can be alternatively fitted with any other pole attachment/coupling mechanism, including mechanical arms such as cam pinchers and scissor pinchers, etc. Other connection devices could include cable, rope, sling or mechanical linkage such as a bar with socket ends to allow for movement. Chain allows reasonable freedom of movement along with relative high strength and abrasion resistance. Cable could also be used while maintaining strength and some abrasion resistance, although at somewhat of a loss of freedom of motion. Likewise, a rope or sling could be used with excellent freedom of movement, but a loss of abrasion resistance and strength. Lastly, a mechanical arm provides excellent strength and abrasion resistance, but would require the pole attachment site 140 to be more precisely located relative to the post. The mass of the trailer 200 to which the pulling mechanism 100 is fixed supports the mast 110 against reactive movement due to the forces from the elongated arm 120 as the post is extracted from the ground.

In the exemplary embodiment, the first location 122 is closer to the mast 110 than is the second location 124, to allow for a greater vertical range of the post attachment site 140. In the exemplary embodiment, the chain 160 can be selectively coupled to any of the one or more openings of the post attachment site 140 to vary the pulling power and/or the vertical range of the chain 160. In other exemplary embodiments, the second location 124 is closer to the mast 110 than is the first location 122, to provide greater torque.

In the exemplary embodiment, as discussed above, the pulling mechanism 100 is mounted to a trailer 200, with the mast 110 of the pulling mechanism 100 being fixed to the trailer 200. Fixing the pulling mechanism 100 to a trailer 200 may be advantageous over fixing the pulling mechanism 100 to a truck, as a trailer 200 can allow for a setup which is lower to the ground. However, the pulling mechanism 100 can be mounted to a truck in alternative embodiments.

In the exemplary embodiment, the system 300 further includes an installing mechanism 400 for installing posts which includes a second elongated arm 310 rotatably and pivotably supported by the mast 110 and extending at a second angle relative to the mast. Alternatively, the second elongated arm 310 is rotatably and pivotably supported by a second mast (not shown) separate from the mast 110. The installing mechanism 400 of the exemplary embodiment also includes a hydraulic cylinder 320, an extender 330, and a post driver 220.

In the exemplary embodiment, the second elongated arm 310 is rotatably supported by the mast 110 by being mounted to a beam 185 which is configured to rotate around the mast 110 in the same manner as the beam 175. In particular, in the exemplary embodiment, the beam 185 is fixed, such as by welding, between bushings 180 and 182 that extend at least partially around the mast 110 and are configured to rotate around the mast 110 without moving axially relative to the mast 110. In the exemplary embodiment, the beam 185 is provided higher on the mast 110 than the beam 175.

The second elongated arm 310 can be configured to be hand-powered to rotate around the mast 110, or to be driven by a motor to rotate around the mast 110. The motor can be electrically powered, hydraulically powered, pneumatically powered, gas powered, or powered in any other suitable manner known in the art. In the exemplary embodiment, a hydraulic motor 125 is configured to rotate the second elongated arm 310. In particular, in the embodiment, a gear fixed to the output shaft of the hydraulic motor 125 meshes with a gear 127 fixed to the mast 110. The hydraulic motor 125 is configured to rotate with the bushing 180/bushing 182/beam 185 assembly, so that actuation of the hydraulic motor 125 in a forward or reverse direction will cause the hydraulic motor 125, the bushing 180/bushing 182/beam 185 assembly and the second elongated arm 310, to rotate in a clockwise or counterclockwise direction. Alternatively, the gear 127 can be fixed to the bushing 180/bushing 182/beam 185 assembly and the hydraulic motor 125 fixed to the mast 110, so that actuation of the hydraulic motor 125 in a forward or reverse direction will cause the gear 127, along with the bushing 180/bushing 182/beam 185 assembly and the second elongated arm 310, to rotate in a clockwise or counterclockwise direction.

In the exemplary embodiment, the second elongated arm 310 is pivotably supported by a hinge mechanism 181, by which the second elongated arm 310 is mounted to the beam 185, and which is configured to allow the second angle of the elongated arm 310 to vary relative to the mast 110. In the exemplary embodiment, a hydraulic cylinder 320 is configured to pivot the second elongated arm 310 relative to the mast 110. The hydraulic cylinder 320 in the embodiment is mounted at one end, by a hinge mechanism 183, to the beam 185, and at the other end to the elongated arm 310 by a hinge mechanism 184. The hydraulic cylinder 320 therefore rotates with the second elongated arm 310 about the mast 110 as the structure including the beam 185 and bushings 180 and 182 is rotated about the mast 110. The second elongated arm 310 and hydraulic cylinder 320 can alternatively be rotatably supported about the mast by roller bearings or other types of bearings. Furthermore, instead of the hydraulic cylinder 320, the second elongated arm 310 can be configured to be hand-powered to pivot relative to the mast 110, or to be driven by a motor to pivot relative to the mast 110. Such a motor can be electrically powered, hydraulically powered, pneumatically powered, gas powered, or powered in any other suitable manner known in the art In the exemplary embodiment, the post driver 220 is a compressed air operated post driver unit mounted to the second elongated arm 310. In the exemplary embodiment, the post pulling and installing system 300 further comprises an extender 330 (in the embodiment, a hydraulic cylinder) configured to extend the second elongated arm 310 as the post driver 220 hammers a post during installation, thereby extending the range at which the post driver 220 can be positioned away from the trailer 200.

In the exemplary embodiment, the trailer 200 includes support posts 230 configured to secure the elongated arms 120 and 310 during transport of the trailer 200.

In an exemplary embodiment, the trailer 200 includes a hydraulic pump configured to power any or all of the hydraulic cylinders of the post pulling and installing system 300. In the exemplary embodiment, a valve assembly 128 mounted to the housing of the hydraulic pump can selectively supply hydraulic positive or negative pressure to the hydraulic cylinders and hydraulic motors of the system. The trailer 200 can also include an electrical battery configured to power any or all of the electric motors of the post pulling and installing system 300, a combustion engine configured to power any or all driving systems of the post pulling and installing system 300, and/or a pneumatic pump configured to power any or all pneumatic cylinders of the post pulling and installing system 300, including the post driver 220, which can be advantageously a pneumatic hammer having a pneumatically driven hammer inside a relatively heavy (e.g. over 100 lbs.) housing to keep the hammer positioned on a post during the hammering operation. The post driver 220 can be a commercially available pneumatic hammer such as the Rhino air driver PD-140 manufactured by Rhino Tool Company, Kewanee, Ill., USA (shown).

It will be appreciated by those skilled in the art that the disclosure herein can be embodied in other specific forms without departing from the spirit or essential characteristics thereof. The presently-disclosed embodiments are therefore considered in all respects to be exemplary and not restricted. The scope of the invention is indicated by the appended claims rather than the foregoing description and all changes that come within the meaning and range and equivalence thereof are intended to be embraced therein.

What is claimed is:

1. A post pulling and installing system comprising:

a mast extending along a direction having a vertical component;

a first elongated arm rotatably and pivotably supported by the mast and extending at a first angle relative to the mast;

a second elongated arm rotatably and pivotably supported by the mast and extending at a second angle relative to the mast;

a pusher with first and second opposite ends, the first end of the pusher being configured to support the first elongated arm at a first location of the first elongated arm, and the second end of the pusher being configured to contact a ground surface, the pusher being configured to increase in length to drive the first location of the first elongated arm away from a ground surface and thereby change the angle relative to the mast;

a post driver supported by the second elongated arm, and a pole attachment site at a second location of the first elongated arm.

2. The system for pulling posts of claim 1, wherein the mast extends in a vertical direction.

3. The system for pulling posts of claim 1, further comprising a mount portion which rotatably supports at least the first elongated arm, which extends at least partially around the mast, and which is configured to rotate around the mast.

4. The system for pulling posts of claim 1, further comprising a motor configured to cause rotation of at least the first elongated arm around the mast.

5. The system for pulling posts of claim 1, further comprising a hinge configured to pivotably support the first elongated arm and which is configured to vary the first angle of the first elongated arm relative to the mast.

6. The system for pulling posts of claim 1, further comprising a motor configured to cause at least the first elongated arm to pivot relative to the mast.

7. The system for pulling posts of claim 1, wherein the pusher is a hydraulic cylinder.

8. The system for pulling posts of claim 1, wherein pole attachment site includes one or more openings.

9. The system for pulling posts of claim 1, further comprising a chain coupled to the pole attachment site and configured to be wrapped around a post during operation of the system for pulling posts.

10. The system for pulling posts of claim 1, wherein the first location of the first elongated arm is closer to the mast than is the second location of the first elongated arm.

11. The post pulling and installing system of claim 1, further comprising a mount portion which rotatably supports the second elongated arm, which extends at least partially around the mast, which is configured to rotate around the mast.

12. The post pulling and installing system of claim 1, further comprising a second elongated arm motor configured to cause the second elongated arm to rotate around the mast.

13. The post pulling and installing system of claim 12 further comprising a gear that is fixed to an output shaft of the second elongated arm motor and that meshes with a gear fixed to the mast.

14. The post pulling and installing system of claim 1, further comprising a second elongated arm hinge configured to pivotably support the second elongated arm by the mast.

15. The post pulling and installing system of claim 1, wherein the post driver is a compressed air operated post driver unit.

16. The post pulling and installing system of claim 1, further comprising an extender configured to extend the second elongated arm.

17. A trailer comprising the post pulling and installing system of claim 1.

18. The trailer of claim 17, further comprising support posts configured to secure the first and second elongated arms during transport of the trailer.

* * * * *